United States Patent [19]

Lyman

[11] 4,109,753

[45] Aug. 29, 1978

[54] MUFFLER ASSEMBLY

[75] Inventor: Steven P. Lyman, Palos Hills, Ill.

[73] Assignee: Midas-International Corporation, Chicago, Ill.

[21] Appl. No.: 743,136

[22] Filed: Nov. 19, 1976

[51] Int. Cl.[2] ..... F01N 1/10

[52] U.S. Cl. ..... 181/252; 181/264; 181/280

[58] Field of Search ..... 181/264, 279, 280, 281, 181/256, 252

[56] References Cited

U.S. PATENT DOCUMENTS

| | | | |
|---|---|---|---|
| 3,209,861 | 10/1965 | Whitney | 181/252 |
| 3,235,003 | 2/1956 | Smith | 181/256 X |
| 3,710,891 | 1/1973 | Flugger | 181/256 |

*Primary Examiner*—Donald G. Kelly

[57] ABSTRACT

A muffler assembly for substantially dampening acoustical vibrations of engine exhaust gases. The muffler assembly includes flow control means, such as a diffuser having a centrally disposed baffle with radially extending deflector vanes having axially extending tabs. The diffuser can be positioned in a tubular expansion joint which is secured to an apertured louver tube within a loosely compact shell of sound attenuating material. The diffuser substantially blocks and restricts the axial flow of exhaust gases along portions of the longitudinal axis of the louver tube, deflects the flow of exhaust gases toward the sound attenuating material and creates turbulent flow.

22 Claims, 5 Drawing Figures

Fig. 4. NO DIFFUSER

Fig. 5. 45° DIFFUSER

MUFFLER ASSEMBLY

BACKGROUND OF THE INVENTION

This invention relates to an acoustical control system, and more particularly, to a new and improved muffler assembly for use with internal combustion engines.

Mufflers particularly of the glasspack type are advantageous in diminishing the noise level of outlet exhaust gases being discharged from automobiles. Recent changes in environmental and noise pollution control laws, have imposed stringent limitations on the minimal acceptable noise level of engine exhaust gases being discharged into the atmosphere. One such law has been recently enacted in the State of California and requires the acoustical level of engine exhaust gases to be no greater than 95 decibels. Many existing mufflers do not have the capacity to limit the acoustical level of engine exhaust gases to a minimum acceptable level and therefore the need exists to design an improved muffler assembly for achieving such desirable results.

SUMMARY OF THE INVENTION

A new and improved muffler assembly is provided for use in an exhaust system of an engine for limiting the acoustical level of engine exhaust gases.

The muffler assembly defines a fluid flow passageway, such as an elongated apertured louver tube, communicating with sound attenuating means that substantially limits the noise level of engine exhaust gases in response to the axial velocity of said exhaust gases. Desirably, the sound attenuating means takes the form of a tubular shell of sound attenuating material.

Flow control means, such as a diffuser, is operatively positioned relative to the fluid flow passageway for directing the flow of exhaust gases toward the sound attenuating means, for creating turbulent flow in the fluid flow passageway and for reducing the axial velocity of the exhaust gases passing through the fluid-flow passageway. In a preferred form, the flow control means includes a diffuser having baffle means for substantially blocking and restricting the axial flow of exhaust gases along portions of the longitudinal axis of the fluid flow passageway and includes a plurality of radially disposed deflector vanes extending outward from the baffle means for radially deflecting the flow of exhaust gases toward the sound attenuating means. Preferably, the deflector vanes are twisted to define an angle of deflection relative to a transverse plane intersecting the longitudinal axis. In one form the angle of deflection ranges from about 35° to about 55°, with a preferred range from about 40° to about 50°. In the most preferred embodiment the angle of deflection is about 45°.

The diffuser of the preferred embodiment includes tab means for facilitating fixed positioning of said diffuser relative to the fluid flow passageway. In the illustrative embodiment such means take the form of a plurality of tangential tabs extending axially away from the outermost portions of the deflector vanes for positioning closely adjacent to an internal wall of a tubular expansion joint which desirably telescopes into and communicates with the inlet of the fluid flow passageway.

In the illustrative embodiment there are at least six and preferably eight substantially stationary and imperforate arcuate blades which define the deflector vanes. Most desirably there are twelve such blades for enhancing the radial deflection of said exhaust gases.

A more detailed explanation of the invention is provided in the following description and appended claims taken in conjunction with the accompanying drawings.

BRIEF DESCRIPTION OF THE DRAWINGS

FIG. 4 is a chart illustrating the velocity profile of engine exhaust gases passing through a louver tube of a conventional muffler without the diffuser of the present invention;

FIG. 5 is a chart illustrating the velocity profile of engine exhaust gases passing through a section of the louver tube of the muffler assembly with a diffuser having a 45° angle of deflection.

DETAILED DESCRIPTION OF THE ILLUSTRATIVE EMBODIMENT

Figure 1:
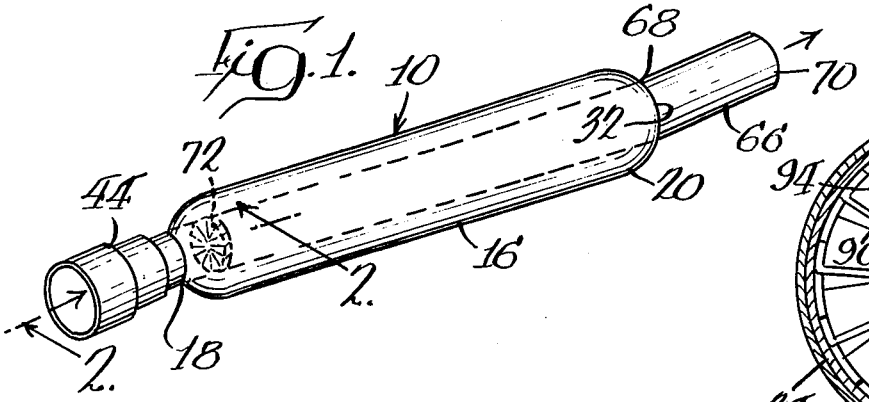
FIG. 1 is a perspective view of a muffler assembly in accordance with principles of the present invention.
Figure 3:
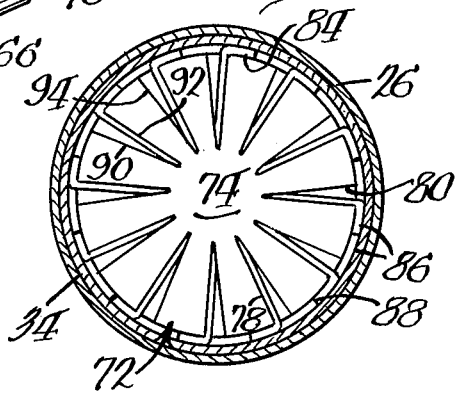
FIG. 3 is a transverse cross-sectional view of a diffuser taken substantially along line 3—3 of FIG. 2.
Figure 2:
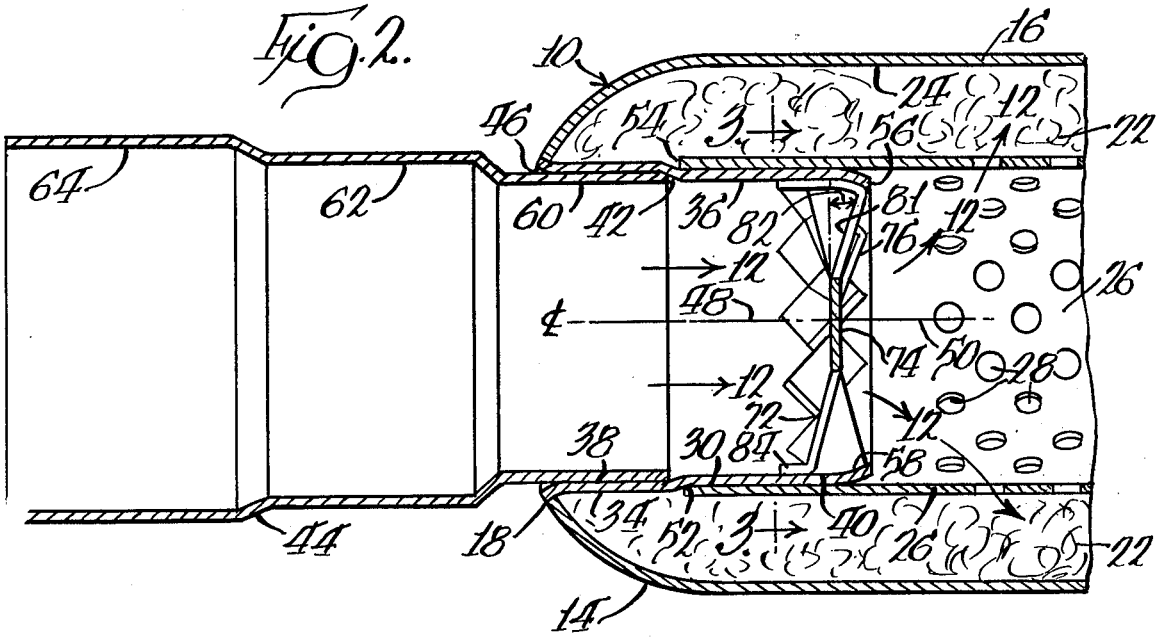
FIG. 2 is an enlarged longitudinal cross-sectional view of a portion of the muffler assembly taken substantially along line 2—2 of FIG. 1.
Figure 2:
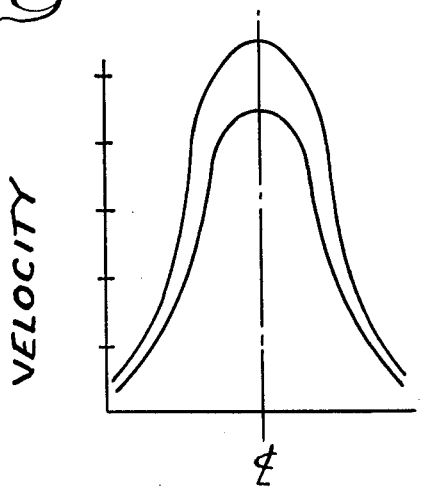
Figure 2:
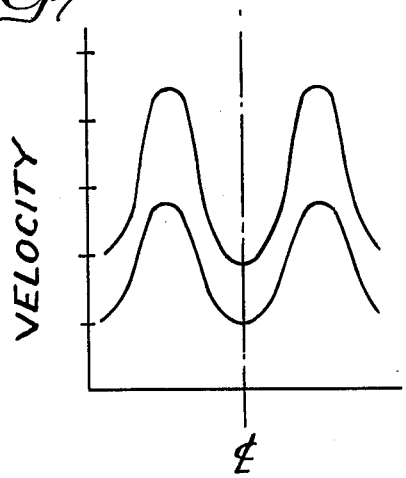

Referring to the drawings in muffler assembly 10 is provided for use in an exhaust system of a power driven engine, and desirably an internal combustion engine for limiting the acoustical or noise level of engine exhaust gases represented by directional arrows 12. The muffler assembly 10 is particularly useful in automobiles, although it may be desirable in certain situations to use the muffler assembly in trucks, motorcycles, lawn mowers, boats, snowmobiles, power machinery or other power driven equipment.

The muffler assembly 10 includes a muffler 14, such as a glass pack muffler, having an external elongated tubular metal muffler housing 16 or blank defining an inlet mouth 18 and a discharge outlet 20. Sound attenuating means, which in the illustrative embodiment, takes the form of a tubular shell of sound attenuating material 22, such as fiber glass, having an annular cross-sectional configuration, confronts the interior wall 24 of the housing 16 to substantially dampen the sound vibrations of the engine exhaust gases 12 and thereby limit the noise or acoustical level of engine exhaust gases. The magnitude, extent and overall efficiency of sound attenuating means is generally dependent upon and responsive to the axial velocity of the exhaust gases 12 passing through the muffler 14. It being generally believed that the slower the axial velocity, the longer time it takes for the sound waves to travel through the sound attenuating material 22 and consequently the greater the time to dampen and otherwise decrease the maximum noise amplitude of the engine exhaust gases 12 resulting in a quieter exhaust output.

The muffler 14 further includes a fluid-flow passageway, such as an elongated foraminous metal louver tube 26 or core having a plurality of apertures 28 communicating with the sound attenuating material 22. Preferably, the louver tube 26 is wrapped within and circumscribed by the fiber glass of the sound attenuating material 22 and is desirably positioned in general concentric relationship with the tubular shell of said sound attenuating material. The louver tube 26 defines an inlet 30 for receiving the engine exhaust gases 12 and an outlet 32 for discharging the gases. Preferably, the louver tube 26 has a circular cross-sectional configuration. The space between louver tube 26 and housing 16 generally forms a chamber defining a sound deadening or attenuating zone into which the sound attenuating material 22 is placed. In the illustrative embodiment the chamber is tubular and has an annular cross-sectional configuration. In some situations it may be desirable to use other types of muffler constructions.

The components of the muffler assembly 10 also include a tubular expansion joint 34 or conduit desirably taking the form of an elongated tubular metal sleeve having an internal annular wall 36 which defines an inlet throat 38 generally positioned in the mouth 18 of the muffler 14 and an outlet throat 40 telescopically coupled to and in communication with the inlet 30 and interior wall of the louver tube 26. The inlet throat 38 has a slightly larger inside diameter than the outlet throat 40 and defines an internal shoulder 42 for abuttingly receiving a tubular inlet nipple 44. Preferably, the inlet throat 38 provides an outwardly flared lip 46 tapered outwardly for telescopically receiving and for facilitating the receipt of the tubular inlet nipple 44. The internal annular wall 36 of the tubular expansion joint 34 generally defines a longitudinal axis 48 which is in general axial alignment and preferably coincides with the longitudinal axis 50 of the louver tube. The exterior surface of the tubular expansion joint provides an external shoulder 52 generally in transverse alignment with the internal shoulder 42 for abutting against the edge 54 of the inlet end 30 of the louver tube 26. The exterior surface surrounding inlet throat 38 intimately contacts and is substantially surrounded and circumscribed by the sound attenuating material 22. The outlet edge 56 of the outlet throat 40 is preferably crimped so as to be tapered inwardly such that it has a smaller outside diameter than other portions of the tubular sleeve 34 to facilitate telescopic engagement into the interior of the louver tube 26. The crimped outlet edge 56 provides an interior abutment or shoulder 58 for snugly engaging the tangential tabs 86 of the diffuser 72, as will hereinafter appear.

The tubular inlet nipple 44 can be of many shapes. In the illustrative embodiment the tubular inlet nipple has an outlet end 60 telescopically coupled to and engaged in the internal annular wall 36 of the inlet throat 38. Tubular inlet nipple 44 includes a neck 62 or tubular middle section which integrally connects the outlet end 60 to the inlet end 64. The inside diameter of the tubular inlet nipple 44 progressively decreases stepwise from the inlet end 64 to the outlet end 60. Desirably, the tubular inlet nipple 44 is in axial alignment with the inlet throat 38 of the expansion joint. The inlet end 64 of the tubular inlet nipple 44 is of a size and shape to telescopically engage the exhaust pipe or tubing communicating with the engine exhaust manifold.

A tubular outlet nipple 66 is telescopically coupled to and engaged to the outlet 32 of the louver tube 26. The tubular outlet nipple 66 preferably has an annular cross-sectional configuration and is in axial alignment with the outlet 32 of the louver tube 26. In the preferred form the tubular outlet nipple 66 has an open inlet end 68 adjacent the outlet of the louver tube 26 and an open outlet end 70 for telescopically receiving the muffler-outlet tube or tailpipe.

The muffler assembly 10 further includes flow control means operatively associated with the fluid flow passageway 26 for substantially blocking and restricting the axial flow of exhaust gases 12 along portions of the longitudinal axis 50 of the fluid flow passageway 26 and for directing the flow of engine exhaust gases 12 towards the sound attenuating means 22. In the illustrative embodiment the flow control means takes the form of a diffuser 72 positioned in the outlet throat 40 of the expansion joint 34 and is made of a fluid impervious material, such as metal. The diffuser 72 has a centrally-disposed shieldlike imperforate baffle 74, which has portions which generally define a transverse reference plane that transversely intersects longitudinal axis 50. In the illustrative embodiment the centrally-disposed baffle is planar or flat and is positioned about and generally transverse to and most desirably perpendicular to the longitudinal axis 50 of louver tube 26. The flat baffle 74 presents a blunt face to the exhaust gases 12 which results in considerable turbulence and substantially blocks and restricts the longitudinal flow of exhaust gases along portions of the longitudinal axis adjacent the outlet throat 40 of the expansion joint 34. In certain situations it may be desirable that the baffle be nose-shaped or convex, pointed, or conversely disc-shaped or concave.

A plurality of radially disposed spaced deflector vanes 76 extend radially outward from the centrally-disposed baffle of the diffuser. In the illustrative embodiment the deflector vanes comprise a set of at least six, and preferably at least eight, stationary imperforate pin-wheel or propeller-like arcuate blades 78 or webs, it being understood that the back pressure of the engine is responsive and generally proportional to the amount of transverse surface area occupied by the deflector vanes or blades. Generally, the greater number of vanes or blades, the greater the surface area of the diffuser 72 for radially deflecting the engine exhaust gases 12 toward the sound attenuating material 22 and the less direct axial flow of the engine exhaust gases 12 resulting in quieter output exhaust gases, but concomitantly creating a greater back pressure resulting in decreased engine efficiency. In the most preferred embodiment twelve such blades or webs are utilized to provide a desired optimum balance between sound attenuation of output exhaust gases and overall engine efficiency. The blades 78 of the diffuser 72 preferably extend to a position closely adjacent the annular or tubular wall 36 of the outlet throat 40 so as to minimize the amount of axial flow of exhaust gases 12 passing through the diffuser and are circumferentially spaced from each other to define a plurality of radial apertures or slits 80 communicating with the interior of the louver tube 26. Each vane or blade 78 has a gas contact surface 81 facing generally toward the sound attenuating material 22 for directing the flow of exhaust gas 12 through the apertures 80 and 28 and into the sound attenuating material 22.

In the illustrative embodiment the blades 78 are twisted and inclined to form a plane which intersects the transverse plane defined by baffle 74 so as to define an angle of deflection 82 ranging from about 35 degrees to about 50 degrees and preferably from about 40 egrees to about 50 degrees. In the most preferred embodiment the angle of deflection 82 is about 45 degrees so as to provide an optimum radial deflection consistent with desired sound attenuation and engine efficiency.

Means are provided for securing the diffuser 72 to the internal tubular wall 36 of the expansion joint 34. In the illustrative embodiment such means take the form of at least one tangential deflector tab 84 and preferably a pair of spaced tangential tabs 86 extending axially from the radially outermost edge of each of the blades 78 of the diffuser 72. Each pair of tabs 86 associated with each of the blades 78 are spaced from each other to define an axial aperture 88 therebetween so as to provide stress relief and permit thermal expansion and contraction as the muffler assembly 10 is heated and cooled. It is believed that the spaced tangential tabs 86 further avoid buckling during forming and bending. In the preferred form the tangential tabs 86 face the inlet throat 38 of the expansion joint 34 and collectively define a circumference slightly larger than the inside diameter of portions of the outlet throat 40 of said expansion joint so that the tangential tabs 86 frictionally engage and wedge against the internal annular wall 36 of the expansion joint resulting in a press-fit engagement between the tangential tabs 86 and the expansion joint. In some circumstances it is preferable to directly weld or braze the tangential tabs 86 to the inner annular wall 36 of the tubular expansion joint rather than press-fitting the tangential tabs to the expansion joint. Other means for connecting the diffuser to the expansion joint can be employed when desired.

In the illustrative embodiment diffuser 72 is stamped out of a single piece of sheet metal and circumferentially-spaced slits are cut into the metal radially outward of centrally-disposed baffle 74 to define and form the blades 78 and tabs 86. Tabs 86 are concurrently or subsequently bent or otherwise deformed to an axial position transverse to, and preferably perpendicular to, the blades. The adjacent radial edges 90 and 92 of adjacent blades on the opposite sides of each slit are bent, twisted or otherwise deformed so that one adjacent radial edge 90 is positioned forwardly or upstream of the transverse reference plane defined by baffle 74 and the other adjacent radial edge 92 is positioned rearwardly or downstream of the transverse plane thereby forming radial apertures 80 of substantial dimension between adjacent blades 78. Preferably the blades are bent uniformly at about the same angle so that the first or clockwise radial edge 94 of each blade, as viewed from the inlet throat 38 of expansion joint 34, is positioned forwardly or upstream of the transverse reference plane defined by the centrally-disposed baffle 74 while the second or counterclockwise radial edge 92 of each blade is positioned rearwardly or downstream of such transverse reference plane.

While the described positioning of the diffuser 72 is preferred, the diffuser can be directly attached to the interior wall of the louver tube downstream of inlet 30 without need of the expansion joint 34 or can be positioned upstream of inlet 30. When desired, a plurality of diffusers 72 can be used.

In operation, the muffler assembly 10 substantially limits the acoustical level of engine exhaust gases 12 to no greater than and preferably less than 95 decibels as measured in accordance with standard procedures of the Society of Automotive Engineers. As the engine finishes its combustion and power stroke, streams of exhaust gases 12 are emitted and discharged at high velocities down the pipe and inlet nipple 44 to the expansion joint 34 where they are deflected and dispersed by the diffuser 72. The diffuser generally reduces the axial velocity of the exhaust gases 12 passing through the louver tube 26 and substantially creates a general turbulent flow pattern in the muffler 14. This turbulent flow pattern is advantageous because it increases the total amount of time in which the sound waves spend traveling through sound attenuating material 22 of the muffler 14 and further serves to enhance the interaction and cancellation of the sound vibrations against each other resulting in a quieter exhaust output. The turbulent flow pattern is most prominent at a point slightly spaced downstream of the diffuser 72 in the louver tube 26.

The baffle 74 of the diffuser 72 substantially blocks and restricts the axial flow of exhaust gases 12 along and adjacent portions of the longitudinal axis of the outlet throat 40 of the expansion joint 34 and louver tube 26. The radial deflector vanes 76 of the diffuser 72 cooperate to radially deflect the flow of exhaust gases 12 generally radially and outwardly through the apertures 80 and 28 and into the sound attenuating material 22. The exhaust gases 12 impinging on vanes 12 can be considered to be deflected in at least two component directions: (a) a first radial direction generally towards the sound attenuating 22, and (b) a second tangential direction generally circumferentially flowing out of apertures 80 and 28 to enhance the turbulence and swirling effect of the exhaust gases 12 flowing through the muffler.

Some of the exhaust gases 12 are deflected by the baffle 74 and deflector vanes 76 toward the tangential deflector tabs 86. The deflector tabs 86 serve to tangentially deflect such deflected exhaust gases toward the radial apertures 80 for passage to the louver tube 26. It is believed that the deflector tabs 86, as well as the deflector vanes 76, enhance the turbulence and swirling effect of the exhaust gases 12 flowing through louver tube 26. The axial tab apertures 88 between the tabs 86 allow some axial flow of the exhaust gases 12 adjacent the internal wall 36 of the tubular expansion joint 34.

After the exhaust gases 12 have passed through the sound attenuating material 22 and the louver tube 26, the muffled exhaust gases 12 flow outward through the outlet nipple 66 and pass through the tailpipe for discharge into the atmosphere. In some exhaust systems a catalytic converter may be further provided to further enhance the quality and environmental purity of the output exhaust gases.

In one performance test satisfactory results were obtained using a 1973 Ford station wagon having a 400 cubic inch engine displacement with a 2V-carburetor single exhaust engine. The engine was run at 2000 rpm converting to 60 mph at an 11.2 horsepower load. The weather on the test day and at the test location was 93° F, 84 percent humidity and 29.88 inches Hg. All measurements were taken for the test after the engine had reached operating temperatures. For the test a 12 blade deflector-vane diffuser was used in conjunction with a muffler having a 24 inch external shell or housing 16. After the engine had reached its operating temperature, the acoustical or noise level of the engine exhaust gases was measured to be 93 decibels, which is desirably below the maximum permissible decibel level, and the back pressure was determined to be 0.70 psi or 36.2 mm Hg, which is a tolerable back pressure that results in an acceptable overall engine efficiency.

FIG. 4 illustrates the velocity profile or pattern of the exhaust gases immediately downstream of the expansion joint when no diffuser was utilized. The center line of the velocity profile generally corresponds to the longitudinal axis of the louver tube. The velocity profile of FIG. 4 depicts a relatively large axial velocity along the longitudinal axis of the louver tube and very little axial velocity or flow through the sound attenuating material.

FIG. 5 illustrates a velocity profile or pattern immediately downstream of a diffuser having a 45° angle of deflection in accordance to the principles of the present invention. The velocity profile shows that the maximum amplitude of the axial velocity of the exhaust gases peaks out and occurs immediately adjacent or within the tubular shell of sound attenuating material. It should be noted that the maximum axial velocity of the engine exhaust gases illustrated in FIG. 5 is substantially less than the maximum velocity of the exhaust gases illustrated in FIG. 4 where there is no diffuser. It can also be observed that the axial velocity along the longitudinal axis of the muffler is greatly reduced when a diffuser is employed.

Although embodiments of this invention have been shown and described, it is to be understood that various modifications and substitutions can be made by those skilled in the art without departing from the novel spirit an d scope of this invention.

What is claimed and desired to be protected and secured by Letters Patent of the United States is:

1. A muffler assembly for substantially limiting the acoustical level of engine exhaust gases, comprising:

a muffler having an elongated tubular housing, an elongated foraminous louver tube disposed within and circumscribed by said tubular housing, said louver tube cooperating with and spaced from said housing to define a tubular chamber therebetween, sound attenuating means disposed in said chamber to define a primary sound attenuating zone for substantially limiting the noise level of engine exhaust gases in response to the axial velocity of said exhaust gases, and said louver tube having an inlet and an outlet and defining a longitudinal axis and a plurality of apertures communicating with sound attenuating means;

a diffuser positioned in communication with said louver tube for reducing the axial velocity of said exhaust gases passing through said muffler and for substantially creating a generally turbulent flow pattern in said muffler, said diffuser being of fluid impervious material and having a centrally-disposed imperforate baffle positioned about said longitudinal axis for substantially blocking and restricting the axial flow of said exhaust gases along portions of said longitudinal axis and including a plurality of deflector vanes extending generally radially outward from said centrally-disposed baffle and spaced from each other to define a plurality of generally radially extending apertures communicating with said louver tube, said vanes deflecting the flow of exhaust gases through said apertures and each vane having a gas contact surface facing generally toward said sound attenuating means for directing the flow of gases passing through said apertures into said sound attenuating means.

2. A muffler assembly in accordance with claim 1 wherein said deflector vanes include a plurality of substantially stationary blades twisted relative to said centrally-disposed baffle.

3. A muffler assembly in accordance with claim 2 wherein said centrally-disposed baffle defines a transverse plane transversely intersecting said longitudinal axis, and said stationary blades define an angle of deflection relative to said transverse plane ranging from about 35° to about 55°.

4. A muffler assembly in accordance with claim 3 wherein said angle of deflection ranges from about 40° to about 50°.

5. A muffler assembly in accordance with claim 3 wherein said angle of deflection is about 45°.

6. A muffler assembly in accordance with claim 1 wherein said deflector vanes comprise a plurality of substantially stationary and imperforate arcuate blades.

7. A muffler assembly in accordance with claim 6 said stationary and imperforate arcuate blades including at least six substantially stationary blades having a substantial transverse surface area.

8. A muffler assembly in accordance with claim 1 wherein said centrally-disposed baffle is generally planar and is positioned generally transverse to said longitudinal axis, and said deflector vanes each have a first radial edge generally disposed upstream of said baffle and a second radial edge generally disposed downstream of said baffle.

9. A muffler assembly in accordance with claim 1 further including:

an expansion joint having a tubular wall defining an outlet throat telescopically coupled to and in communication with the inlet of said louver tube and an inlet throat for receiving said exhaust gases; and means for securing said diffuser to the tubular wall of said expansion joint.

10. A muffler assembly in accordance with claim 9 wherein:

said deflector vanes extend to a position closely adjacent said tubular wall of said expansion joint, and said means for securing said diffuser to the tubular wall of said expansion joint includes a plurality of tangential tabs extending axially outward from the radially outermost portion of said deflector vanes.

11. A muffler assembly in accordance with claim 10 wherein each of said deflector vanes includes two of said tangential tabs, said tabs being circumferentially spaced from each other and positioned to snugly engage the tubular wall of said expansion joint.

12. A muffler assembly in accordance with claim 1 wherein said diffuser includes tab means for facilitating fixed positioning of said diffuser relative to said louver tube.

13. A muffler assembly for use in an exhaust system of an engine, comprising:

a muffler defining a fluid-flow passageway for passage of engine exhaust gases and sound attenuating means communicating with said fluid-flow passageway for substantially limiting the noise level of said exhaust gases; and flow control means including a centrally disposed imperforate baffle operatively associated with and positioned in said fluid-flow passageway, and a plurality of radially disposed deflector vanes extending generally radially outward from said centrally disposed baffle for directing the flow of exhaust gases toward said sound attenuating means.

14. A muffler assembly in accordance with claim 13 wherein said centrally disposed imperforate baffle is generally planar.

15. A muffler assembly in accordance with claim 13 wherein said deflector vanes include a plurality of arcuate blades.

16. A muffler assembly in accordance with claim 15 wherein said arcuate blades are twisted relative to said centrally disposed imperforate baffle at generally similar angles.

17. A muffler assembly for substantially limiting the acoustical level of engine exhaust gases, comprising:

a muffler having sound attenuating means for substantially limiting the noise level of engine exhaust gases in response to the axial velocity of said exhaust gases including a tubular shell of sound attenuating material having an annular cross-sectional configuration, an elongated foraminous louver tube wrapped within and circumscribed by said sound attenuating means and in general concentric relationship with said tubular shell, said louver tube having an inlet and an outlet and defining a longitudinal axis and plurality of apertures communicating with said sound attenuating means, and an elongated tubular housing substantially circumscribing, covering and confronting said sound attenuating material;

an expansion joint comprising an elongated tubular sleeve generally in axial alignment with said muffler and having an internal annular wall defining an outlet throat telescopically coupled to and in communication with the inlet of said louver tube and an inlet throat for receiving said engine exhaust gases; and a diffuser positioned in the outlet throat of said expansion joint for reducing the axial velocity of said exhaust gases passing through said louver tube and for substantially creating a turbulent flow pattern in said muffler, said diffuser being of fluid impervious material and having a generally flat centrally-disposed shield-like imperforate baffle positioned generally transverse to said longitudinal axis for substantially blocking and restricting the axial flow of said exhaust gases along said longitudinal axis adjacent said outlet throat and including a plurality of radially disposed deflector vanes comprising twelve stationary and imperforate arcuate blades circumferentially spaced from each other to define a plurality of radial apertures communicating with said louver tube, said blades extending radially outward from and twisted relative to said generally flat centrally-disposed baffle for radially deflecting the flow of exhaust gases through said radial apertures and toward said sound attenuating means and said diffuser including a plurality of tangential tabs extending axially from said blades and secured to the annular wall of said expansion joint.

18. A muffler assembly in accordance with claim 17 wherein said blades are twisted to define an angle of deflection of about 45°.

19. A muffler assembly in accordance with claim 17 wherein said tangential tabs includes at least two spaced tangential tabs extending axially from each of said blades toward the inlet throat of said expansion joint.

20. A muffler assembly in accordance with claim 19 wherein said tabs collectively define a circumference slightly larger than portions of the outlet throat of said expansion joint for press-fit engagement with said internal annular wall of said expansion joint.

21. A muffler assembly in accordance with claim 20 wherein said tabs are welded to said annular wall.

22. A muffler assembly in accordance with claim 17 further including:

a tubular inlet nipple telescopically coupled to and in axial alignment with the inlet throat of said expansion joint, and a tubular outlet nipple telescopically coupled to and in axial alignment with the outlet of said louver tube.

* * * * *